US006730177B1

(12) United States Patent
Talley et al.

(10) Patent No.: US 6,730,177 B1
(45) Date of Patent: May 4, 2004

(54) METHOD AND APPARATUS FOR WASHING AND/OR DRYING USING A REVOLVED COANDA PROFILE

(75) Inventors: J. Ross Talley, Nampa, ID (US); Wyland L. Atkins, Kuna, ID (US)

(73) Assignee: SCP Global Technologies, Inc., Boise, ID (US)

( * ) Notice: Subject to any disclaimer, the term of this patent is extended or adjusted under 35 U.S.C. 154(b) by 27 days.

(21) Appl. No.: 09/918,750

(22) Filed: Jul. 31, 2001

(51) Int. Cl.[7] ..... B08B 3/00; B08B 3/02

(52) U.S. Cl. ..... 134/34; 134/36; 134/37; 134/42

(58) Field of Search ..... 134/22.18, 26, 134/30, 31, 36, 37, 42

(56) References Cited

U.S. PATENT DOCUMENTS 5,125,979 A * 6/1992 Swain et al. ..... 134/7
5,188,868 A 2/1993 Horii et al. ..... 427/212
6,039,269 A 3/2000 Mandzukic ..... 239/458

* cited by examiner

*Primary Examiner*—Randy Gulakowski
*Assistant Examiner*—Saeed Chaudhry
(74) *Attorney, Agent, or Firm*—Stallman & Pollock LLP

(57) ABSTRACT

A method for exposing an object to fluid using principles of the present invention includes the steps of introducing the object into a coanda flow forming passage and directing a coanda jet onto a coanda profile that surrounds the object to cause amplified flow to surround the object and move axially through the passage. An apparatus for exposing an object to fluid utilizing principles of the present invention includes a chamber having an enclosed coanda profile and a fluid inlet such as a coanda slot fluidly coupled to the passage. The passage is proportioned to receive an object to be treated. In one embodiment of the method and apparatus, fluid apertures for focusing an additional fluid onto the object may be positioned within the chamber, and a fluid may be directed from the apertures onto the object to clean the object before the object is dried using the amplified flow through the chamber.

30 Claims, 8 Drawing Sheets

METHOD AND APPARATUS FOR WASHING AND/OR DRYING USING A REVOLVED COANDA PROFILE

BACKGROUND OF THE INVENTION

In manufacturing processes requiring high levels of cleanliness, it becomes necessary to clean and dry the robotic devices used to handle products undergoing manufacture. One context in which this is extremely important is during the manufacture of semiconductor wafers. For example, during wet processing of wafer substrates robotic end effectors carry the substrates between chemical processing steps, rinse steps, and or drying steps. Between certain of these steps it is important to clean the end effectors so that substances that adhere to the end effectors during wafer transport are not transferred back onto the wafers when the wafers are subsequently retrieved by the same end effectors. For example, droplets or films of chemical solution are likely to be deposited onto an end effector used to transport a wafer away from a chemical process chamber and into a rinsing chamber. It will be important to remove these deposits from the end effector before the end effector retrieves the wafers from the rinsing chamber for transport to a drying chamber—so that the deposits are not transferred back onto the wafer. In other contexts, periodic washing and drying of end effectors may be important towards minimizing particle contamination of the end effectors and wafers.

It is desirable to provide a cleaning/drying tool for process end effectors that minimizes process time, process fluid (e.g. cleaning/drying fluids and/or gases) consumption, and footprint size.

SUMMARY OF THE INVENTION

A method for exposing an object to fluid using principles of the present invention includes the steps of introducing the object into a flow passage and directing a high velocity stream onto a coanda profile that surrounds the object. This causes a cylindrical amplified flow to surround the object and move axially through the passage. An apparatus for exposing an object to fluid utilizing principles of the present invention includes a chamber having an enclosed coanda profile and a fluid inlet coupled to the passage. The passage is proportioned to receive an object to be treated. In one embodiment of the method and apparatus, nozzles for focusing an additional fluid onto the object may be positioned within the chamber, and a fluid may be directed from the nozzles onto the object to clean the object before the object is dried using the amplified flow induced in the chamber.

DETAILED DESCRIPTION

Figure 1:
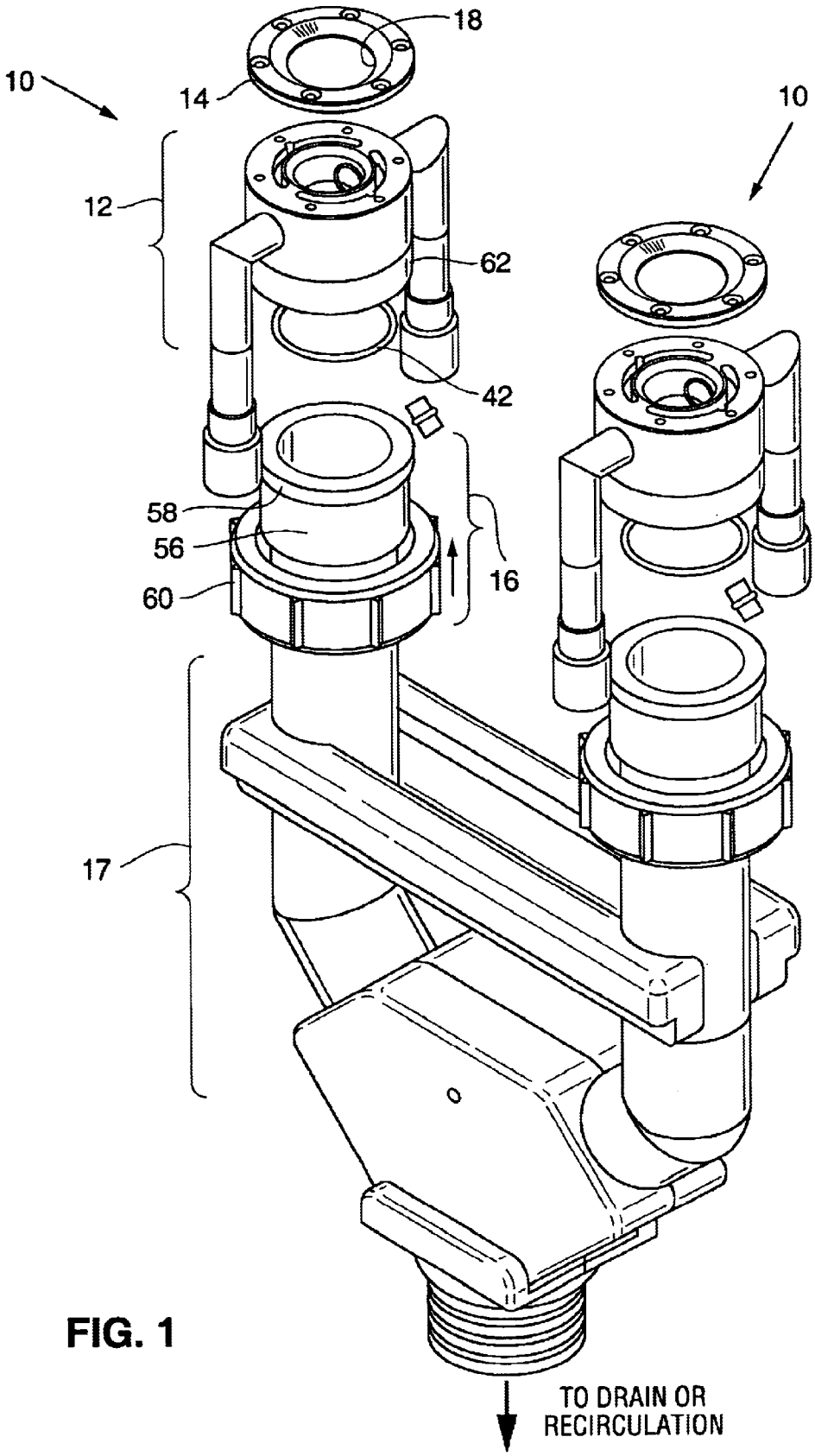
FIG. 1 is an exploded perspective view showing a pair of wash/dry apparatuses utilizing principles of the present invention, coupled to common drain plumbing.

One embodiment of an apparatus for washing and/or drying using a coanda profile is shown in the drawings. This embodiment will be described for use in washing and drying the end effectors of robotic components used to transport semiconductor wafer substrates between processing steps. The embodiment is described this way only for purposes of convenience, as the apparatus and method may be equally suitable for use in treating other articles to be washed, dried, and/or otherwise treated with fluids.

Referring to FIG. 1, a coanda washing apparatus 10 includes a manifold 12, cap 14 attached to manifold 12, and drain plumbing 16 positioned to receive fluids from manifold 12 and to direct such fluids through system plumbing 17 for disposal or recirculation. The apparatus 10 may be used independently, or two or more such apparatuses 10 may be used side-by-side as a part of a larger assembly as shown in FIG. 1. The components are preferably made from a material inert to the chemicals that are to be cleaned from the end effectors using the apparatus 10. For example, in a semiconductor environment PVDF or PFA is desirable for the manifold 12, cap 14 and associated plumbing.

Figure 2:
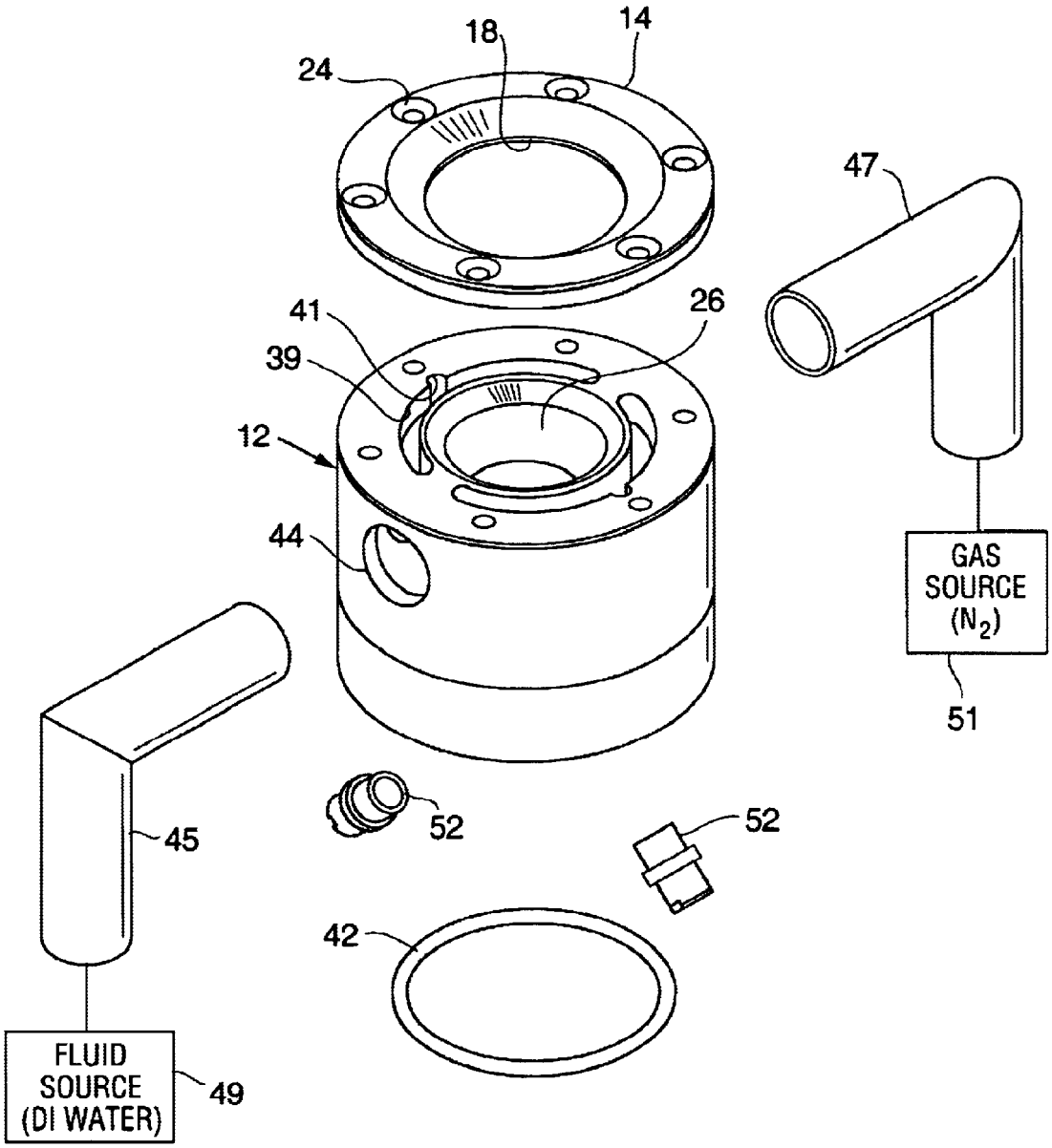
FIG. 2 is an exploded perspective view of one of the wash/dry apparatuses of FIG. 1.
Figure 3:
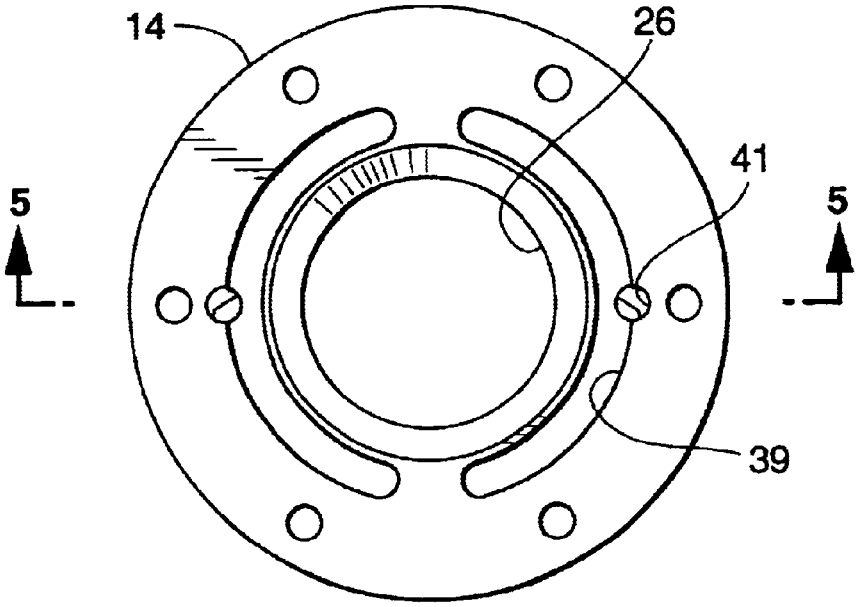
FIG. 3 is a top plan view of the manifold of the wash/dry apparatus of FIG. 2.
Figure 9:
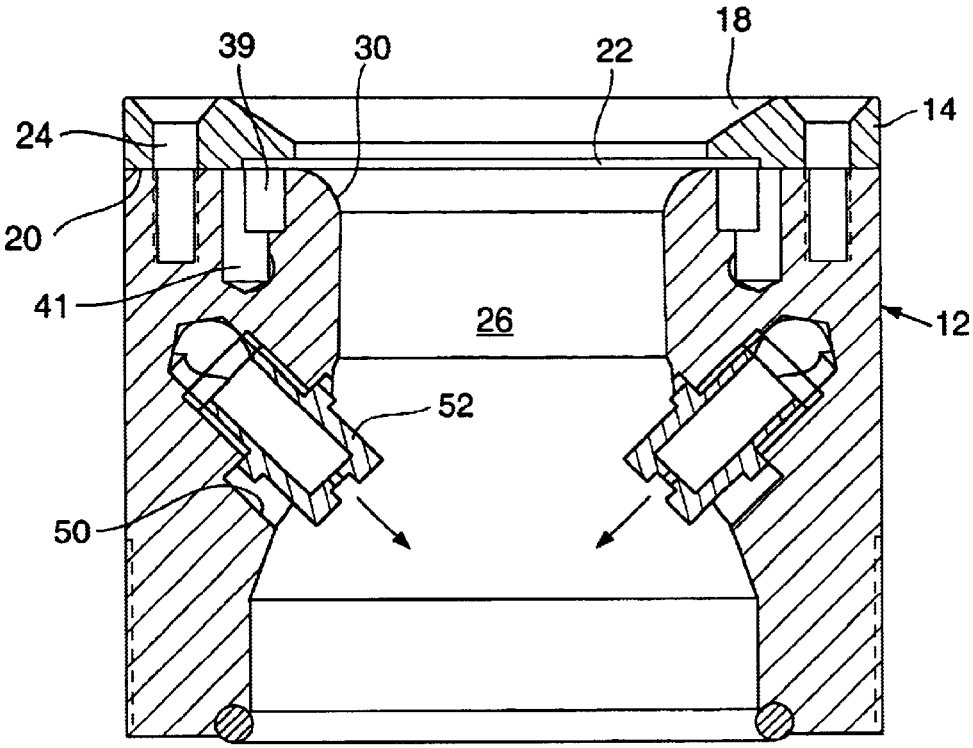
FIG. 9 is a cross-section view similar to FIG. 5, showing the spray nozzles in place and the cap on the manifold.

Referring to FIGS. 2 and 9, cap 14 includes a central opening 18 beveled downwardly from the upper surface of the cap. On the underside 20 (FIG. 9) of the cap 14 is a circular cutout 22 that creates a narrow slot between the cap 14 and manifold 12. A plurality of throughbores 24 are shown for receiving fasteners used to hold the cap 14 on the manifold 12.

Manifold 12 (FIG. 2) includes a central chamber 26 having a diameter that varies from the top to the bottom of the manifold 12 to form a coanda profile (i.e. a profile that will induce coanda flow in the supply fluid), a constricted chamber, and an expansion chamber. The profile is "revolved" in that it extends 360° around the chamber interior to encircle the object for treatment. The revolved profile may be formed using a lathe or other means.

Figure 8:
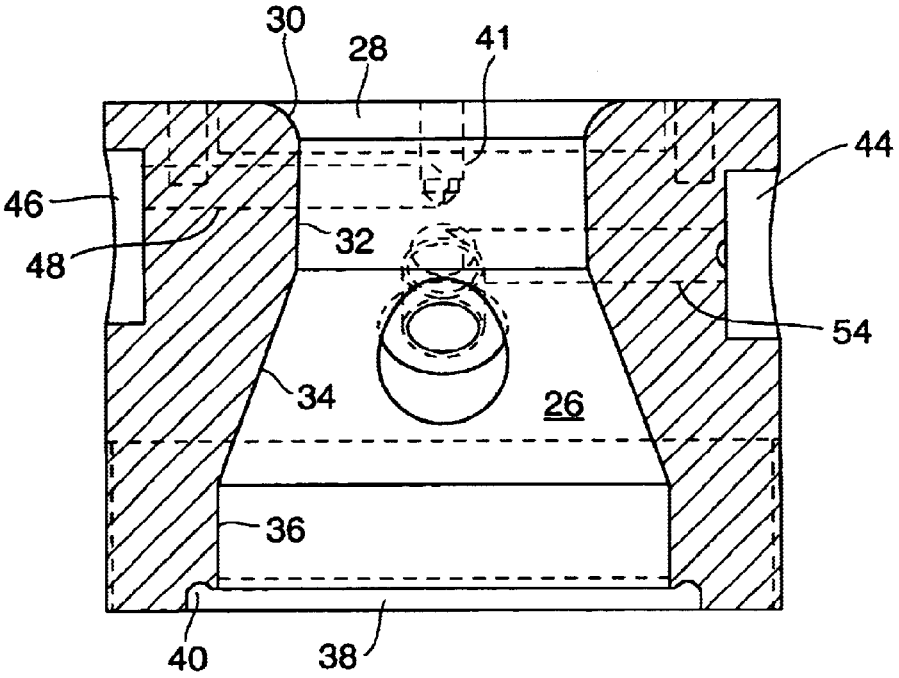
FIG. 8 is a cross-section view of the manifold taken along the plane designated 8-8 in FIG. 4.

Referring to the cross-section view of the chamber 26 in FIG. 8, it can be seen that the upper opening 28 that leads into the chamber 26 has rounded edges 30 that transition from the horizontal plane to the vertical chamber walls. These rounded edges form the coanda profile. Downstream of the rounded edges 30 lies a relatively narrow cylindrical region 32 of the chamber, and downstream of this constricted region 32 is a flared expansion region 34. A second, larger diameter, cylindrical region 36 lies downstream of flared region 34. At the lower opening 38 of the chamber 26 is a circular seat 40 proportioned to receive an o-ring 42 (FIG. 1), which, when the manifold is coupled to drain plumbing 16 (FIG. 1), seals the connection between the manifold and the drain plumbing.

Referring to FIGS. 2 and 9, a pair of arcuate grooves 39 are formed in the upper surface of the manifold 12. Centrally disposed along each groove 39 is a downwardly extending bore 41. When cap 14 is secured to manifold 12 as shown in FIG. 9, circular cutout 22 on the underside of cap 14 is positioned over the grooves 39 and bores 41 to create a narrow "coanda slot" between them.

Figure 4:
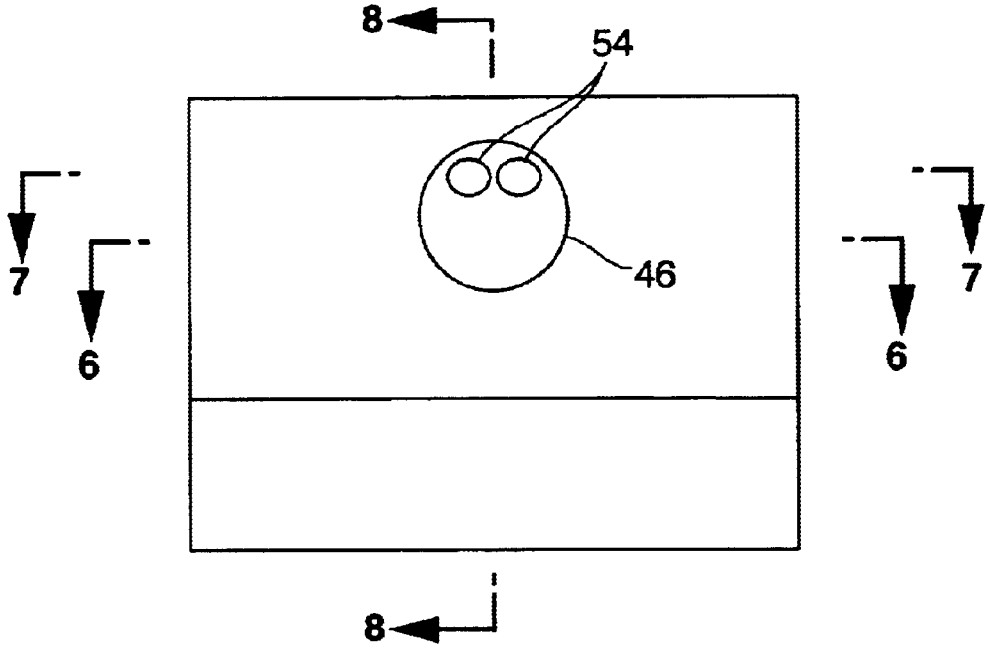
FIG. 4 is a side elevation view of the manifold of FIG. 3.

Side ports 44 (FIG. 2) and 46 (FIG. 4) are positioned on opposite sides of manifold 12. In one method utilizing principles of the invention, port 44 is a deionized ("DI") water port, and port 46 is a nitrogen gas port. Elbow fittings 45, 47 are mounted to ports 44,46 to connect the ports to the appropriate fluid and/or gas sources such as a DI water source 49 and a nitrogen gas source 51.

Figure 6:
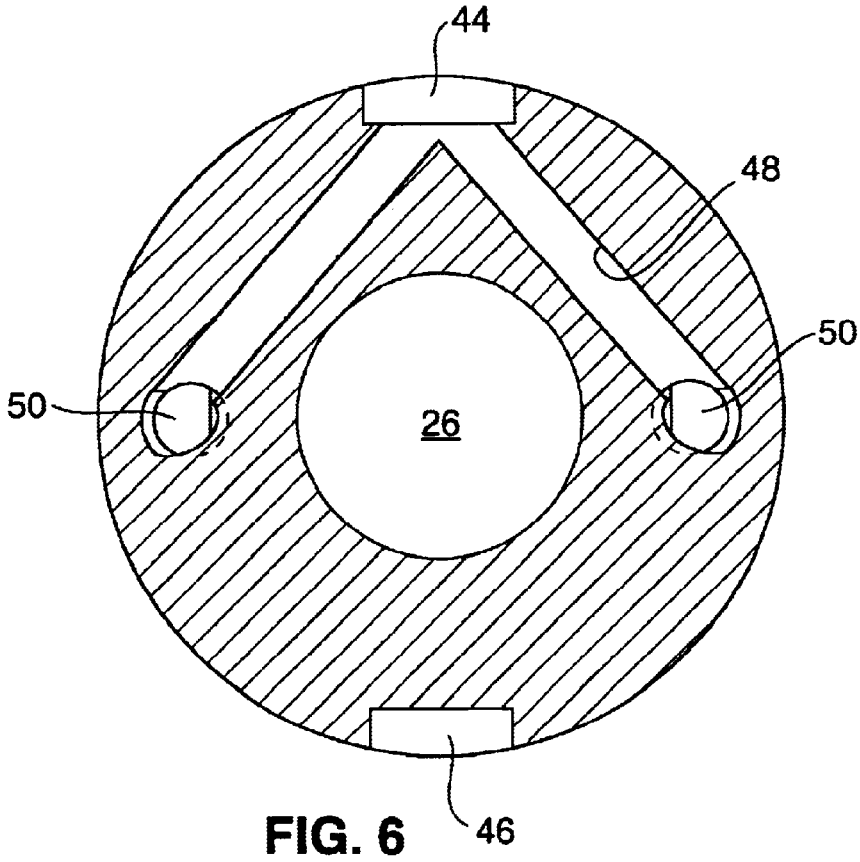
FIG. 6 is a cross-section view of the manifold taken along the plane designated 6-6 in FIG. 4.

Referring to FIG. 6, tubular branches 48 extend from DI water port 44 to opposite sides of central chamber 26. Each tubular branch 48 terminates at a fluid aperture such as interior port 50. These fluid apertures preferably include spray nozzles 52 which are disposed in the interior ports 50 (as shown in FIG. 9) when the manifold is fully assembled. Thus, DI water introduced into water port 44 travels through the bifurcated flow path formed by branches 48 and is propelled into the central chamber 26 by spray nozzles 52.

Figure 5:
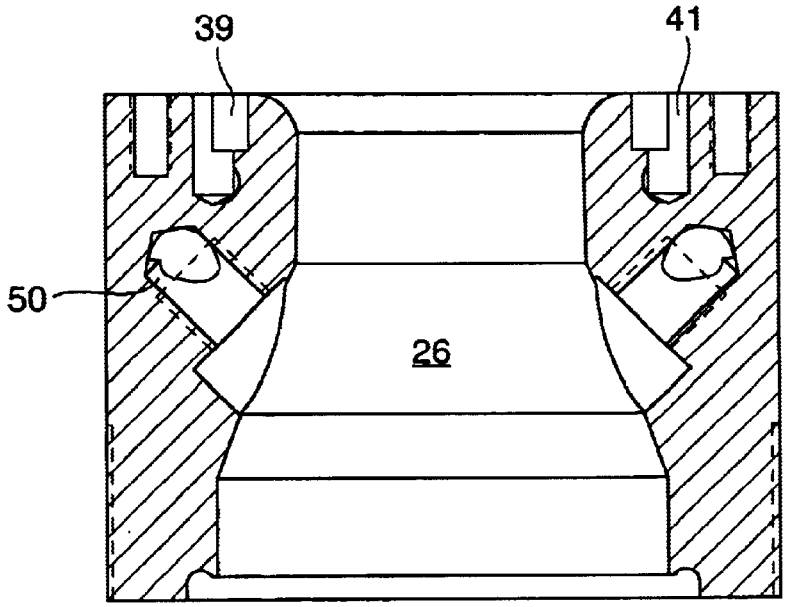
FIG. 5 is a cross-section view of the manifold taken along the plane designated 5-5 in FIG. 3.
Figure 7:
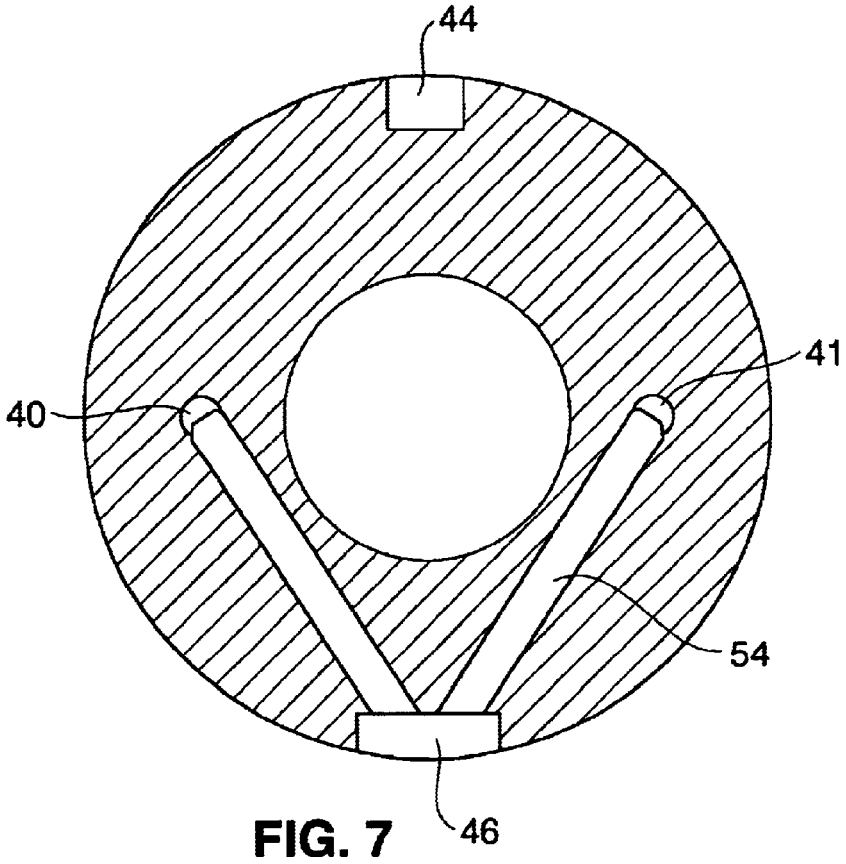
FIG. 7 is a cross-section view of the manifold taken along the plane designated 7-7 in FIG. 4.

As shown in FIG. 7, tubular branches 54 extend from gas port 46. The branches 54 fluidly intersect with upwardly extending bores 41 (see also FIG. 5). Nitrogen gas introduced into gas port 46 passes through branches 54 and bores 41, and into the narrow coanda slot defined between arcuate grooves 39 and the cutout 22 (FIG. 9) on the undersurface of cap 14.

Drain plumbing 16, FIG. 1, comprised of standard plumbing components, includes a pipe section 56 having an increased-diameter lip 58 at its upper end. A collar 60 serves to connect pipe section 56 to manifold 12. Collar 60 is slidably positioned on the exterior surface of pipe section 56 and includes a threaded interior surface. The lower exterior of manifold 12 has a corresponding threaded surface 62. To assemble the plumbing 16 and manifold 12, collar 60 is advanced in the direction of the arrow in FIG. 1 and then screwed into engagement with threaded surface 62 of manifold 12. Lip 58 is proportioned to prevent collar 60 from becoming detached from pipe section 56. Drain plumbing 16 is further connected to system plumbing 17 that directs fluids draining from manifold 12 away from the manifold for disposal or reconditioning/recirculation.

Figure 10:
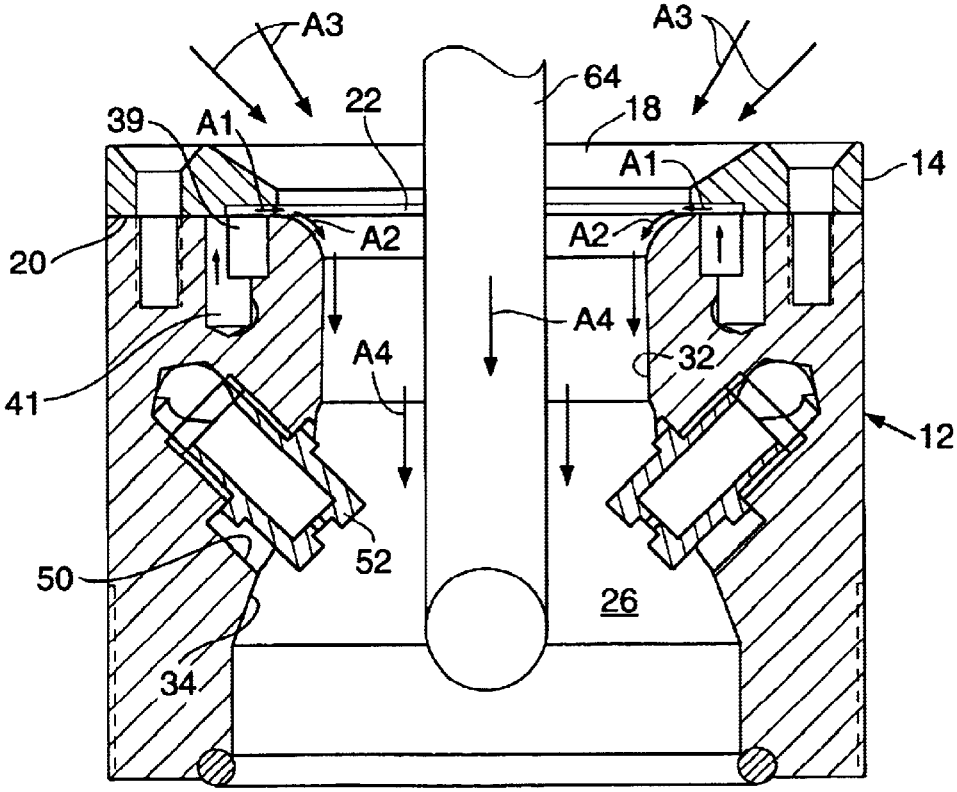
FIG. 10 is a cross-section view similar to FIG. 9, illustrating use of the apparatus to clean end effectors.
Figure 11:
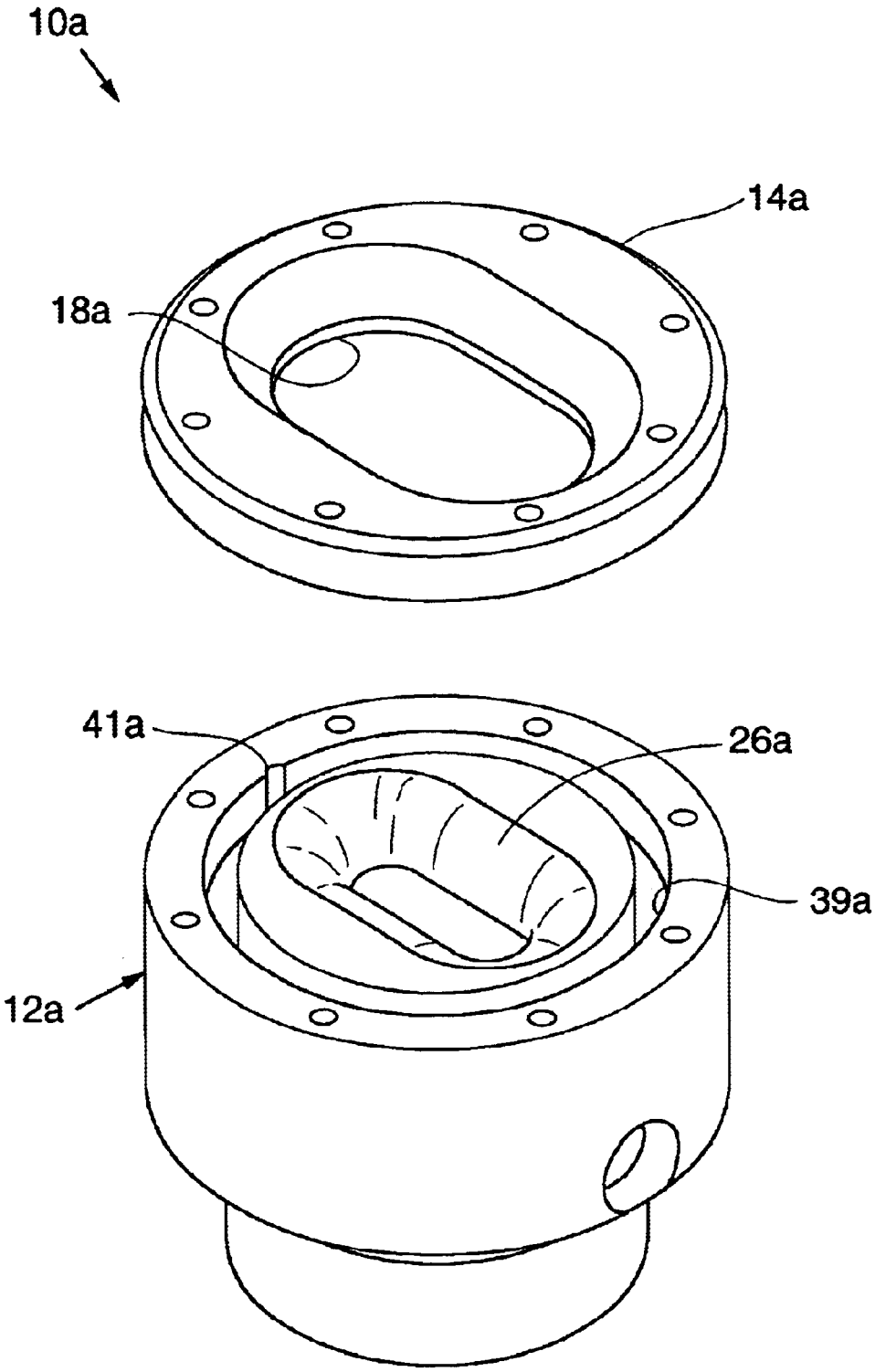
FIG. 11 is a perspective view of an alternate embodiment of a manifold and cap assembly.
Figure 12A:
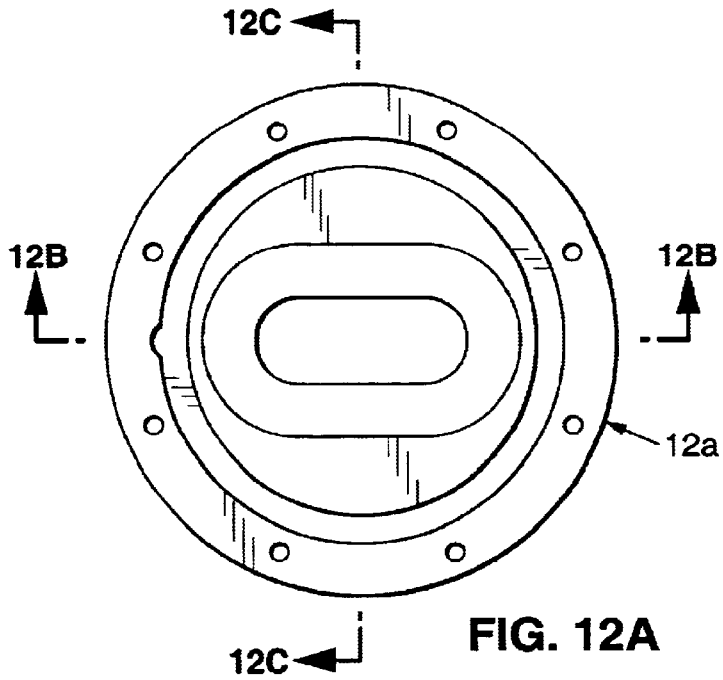
FIG. 12A is a top elevation view of the manifold of FIG. 11.
Figure 12B:
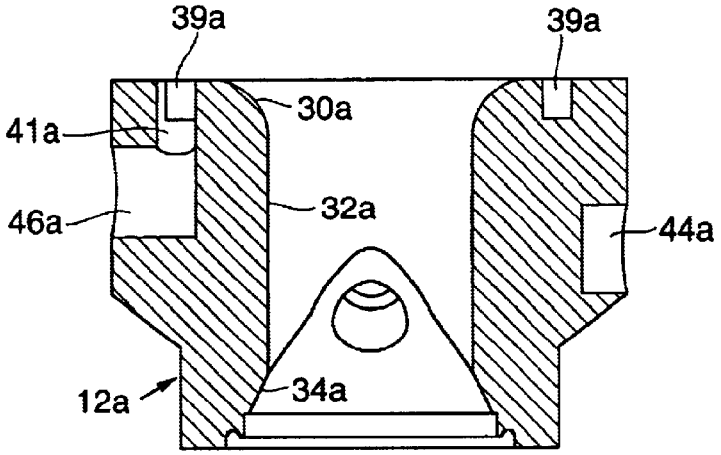
FIG. 12B is a cross-sectional side view of the manifold taken along the plane designated 12B-12B in FIG. 12A.
Figure 12C:
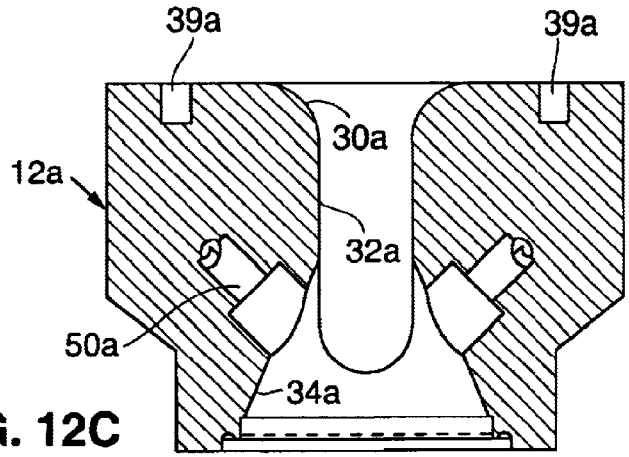
FIG. 12C is a cross-sectional side view of the manifold taken along the plane designated 12C-12C in FIG. 12A.

Operation of the system 10 will next be described. With the manifold 12, cap 14 and plumbing 16 fully assembled, an object such as a process end effector 64 is passed vertically downward through opening 18 in the cap 14 and into the central chamber 26 of manifold 12 as shown in FIG. 10. A cleaning fluid, which may be DI water or a cleaning solution, is introduced into elbow pipe 45 that leads to inlet 44 (FIG. 2). The cleaning fluid moves from inlet 44 through tubular branches 48 (FIG. 6) and is focused onto the end effector by spray nozzles 52, thus cleaning the end effectors as they are passed through the chamber. Rinsing in this method of close proximity requires only minimal rinse fluid. Also, because the chamber 26 has a constricted region 32 positioned above the elevation of the nozzles 52 and expansion chamber 34, there is minimal mist rise out of the chamber 26 during cleaning.

Fluid exits the bottom of the chamber 26 and travels through plumbing 16, 17 where it may be disposed of or recirculated for reuse.

After cleaning has been performed, flow of cleaning fluid into the chamber 26 is terminated. The end effector or other object is discontinued in its descent and is passed vertically upward for the drying process. An inert drying gas such as nitrogen is introduced into inlet 46 via elbow connector 47 (FIG. 2). The gas passes through tubular passages 54 (FIG. 7), then moves upwardly through bores 41 and into the arcuate grooves 39 (FIGS. 2, 7 and 10), filling the volume of the grooves 39. From the arcuate grooves 39, the gas is forced through the narrow slot 22 (FIG. 10) formed in the underside of cap 14. Passage through the narrow cutout creates a high velocity flow (which is horizontal in FIG. 10) directed toward the central axis of the manifold chamber as indicated by arrows A1. Naturally, this high velocity flow can be generated using various other methods known to those skilled in the art.

Referring to FIG. 10, the Coanda effect, which is the tendency of fluids (including air or gases) to attach to and follow the curved surface of a wall, causes the coanda jet (the high velocity turbulent gas stream emitted from coanda slot 22 and indicated by arrows A2) to follow the profile of the chamber wall, creating a cylindrical high-speed thin-wall attached flow (i.e. coanda flow) through the chamber. As can be seen in FIG. 10, the Coanda profile subtends an arc from horizontal to vertical, meaning that the gas travels in a horizontal direction (A1) through the coanda slot and then follows the chamber wall into a vertical flow orientation (A2).

One effect of the coanda flow is the entrainment of ambient air. Specifically, as it flows into the chamber, the coanda flow entrains ambient air in the region of the cap's opening 18 and draws the ambient air into the manifold as indicated by arrows A3. The ambient air mixes with the drying gas to create a stream of mixed gas, which flows into the manifold as indicated by arrows A4. In this manner, the manifold operates as an air amplifier that causes drying to occur using a fraction of the nitrogen or other drying gas that would otherwise be used in the process. In one embodiment, the volumetric flowrate of entrained air may exceed ten times the flow rate of the drying gas used.

Because the coanda profile surrounds a central axis, the coanda jet induces cylindrical coanda flow that likewise surrounds the end effectors and promotes unidirectional flow of the entrained air. The velocity of the mixed gas within the chamber 26 is greatest at the constricted section defined by the geometry of wall 32 (FIG. 8). Introduction of an end effector into the chamber further constricts the flow path and increases air velocity through the chamber. Very high stream velocities are easily achieved using a revolved horizontal-to-vertical Coanda profile in this manner. For example, introduction of 5 SCFM of nitrogen at 20 psi will entrain over 50 SCFM of ambient air to produce chamber velocities in excess of 75 mph. The high velocity gas stream shears liquid droplets off of the end effectors to dry the end effectors. The dimensions of the coanda slot 22 (FIG. 9, 10) and the wall 32 are selected for efficiency of air entrainment and velocity through the chamber.

The circumferential shape of the chamber and associated components may be selected according to the dimensions of the object to be treated within the chamber. Thus, although the chamber 26 has a circular shape, alternate shapes may be utilized.

For example, the alternative embodiment 10*a* of FIGS. 11 and 12A through 12C includes a manifold 12*a* having a chamber 26*a* that is elliptical in cross-section. Apparatus 10*a* includes a cap 14*a* having an elliptical central opening 18*a* that is beveled downwardly from the upper surface of the cap. A circular cutout (similar to cutout 22 FIG. 9) is formed in the underside of the cap 14*a* to form the narrow slot between cap 14*a* and manifold 12*a* when assembled.

The central chamber 26*a* of manifold 12*a*, similar to chamber 26 of manifold 12, has internal diameter that varies both radially and vertically to form, from top to bottom of manifold 12*a*, a coanda profile, constriction chamber, and expansion chamber. This profile is also "revolved" in that it extends 360° around the elliptical shape of the chamber interior to encompass the object for treatment. As with the first embodiment, the upper opening 28*a* that leads into the chamber 26*a* has rounded edges 30*a* to induce coanda flow. Downstream of the coanda profile 30*a* lies a constricted flow region 32*a* of the chamber, and downstream of the constricted region 32*a* is a flared expansion chamber 34*a*.

A circular groove 39*a* (similar to arcuate grooves 39) is formed in the upper surface of the manifold 12*a*, and a bore 41*a* extends downwardly from groove 39*a* into the manifold 12*a*. When cap 14*a* is secured to manifold 12*a*, the circular cutout (not shown but see cutout 22 of FIG. 9) on the underside of cap 14*a* is positioned over the groove 39*a* and bore 41*a* to create a narrow slot between them for fluid passage.

Side port 44*a* is a DI water port. As with the first embodiment, tubular side branches (not shown but see branches 48 of FIG. 6) extend from port 44*a* to opposite sides of central chamber and terminate at interior ports 50*a* having spray nozzles (see nozzles 52 of FIG. 2). DI water introduced into water port 44*a* travels through the bifurcated flow path formed by the tubular branches and is propelled into the central chamber 26*a* by the spray nozzles.

A nitrogen gas port 46*a* is positioned on an opposite side of the manifold 12*a* from DI water port 44*a* Gas port 46*a* fluidly intersects with downwardly extending bore 41*a*. Nitrogen gas introduced into gas port 46*a* passes through the bore 41*a*, and into the narrow slot defined between circular groove 39*a* and the cutout on the undersurface of cap 14*a*. As with the first embodiment, this creates a high velocity horizontal flow of gas towards the center of the chamber opening, after which the gas attaches to and follows the curved coanda profile in a vertical direction.

Although two embodiments of the invention have been shown, the invention may be embodied in many different forms and should not be construed as limited to the embodiments set forth herein. Instead, these embodiments are provided so that this disclosure will be thorough and complete, and will fully convey the scope of the invention to those skilled in the art.

We claim:

1. A method for exposing an object to fluid, comprising the steps of:

introducing the object into a coanda flow forming passage by passing the object through an opening into the passage, the coanda flow forming passage including an interior and a wall surrounding the interior, the wall having a coanda profile;

directing a first fluid onto the coanda profile to induce coanda flow through the passage;

withdrawing the object through the opening.

2. The method of claim 1 wherein:

the coanda flow forming passage includes an upstream opening, and the directing step causes an atmosphere exterior of the upstream opening to be entrained by the coanda flow and drawn through the coanda flow forming passage.

3. The method of claim 2 wherein the method is for drying an object using a mixture of drying fluid and entrained air, and wherein the directing step includes directing a drying fluid onto the coanda profile.

4. The method of claim 3 wherein the drying fluid comprises a gas.

5. The method of claim 4 wherein the gas comprises nitrogen.

6. The method of claim 2 wherein the atmosphere comprises ambient air.

7. The method of claim 1 wherein the coanda flow forming passage further includes at least one fluid aperture positioned within the coanda flow forming passage, and wherein the method further includes directing a second fluid through the aperture onto the object.

8. The method of claim 7 wherein the second fluid is a cleaning fluid.

9. The method of claim 8 wherein the cleaning fluid comprises water.

10. The method of claim 7 wherein the step of directing a second fluid onto the object is performed prior to the step of directing a coanda jet, comprised of a first fluid, onto the coanda profile to induce coanda flow.

11. The method of claim 10 wherein the second fluid is a cleaning fluid and the first fluid is a drying fluid.

12. The method of claim 11 wherein the cleaning fluid comprises water.

13. The method of claim 11 wherein the drying fluid comprises a gas.

14. The method of claim 13 wherein the gas comprises nitrogen.

15. The method of claim 1 wherein the coanda flow forming passage includes a reduced diameter section and wherein the method further includes the step of accelerating the first fluid and entrained atmosphere through the flow passage by causing the first fluid and entrained atmosphere to flow through the reduced diameter section.

16. A method of treating an object with a fluid, comprising the steps of:

providing a chamber comprising a coanda passage having an interior and a longitudinal axis, the interior including a surface curved in a longitudinal direction, the chamber further including a coanda slot or other geometry to produce a coanda jet;

passing an object through an opening into the chamber and positioning the object within the coanda chamber, directing a coanda jet, comprised of a first fluid, onto the coanda inducing profile to cause coanda flow through the passage; and withdrawing the object from the coanda chamber and through the opening.

17. The method of claim 16 wherein:

the coanda passage includes an upstream opening, and the directing step causes an atmosphere exterior of the upstream opening to be entrained by the coanda flow and drawn through the coanda passage.

18. The method of claim 17 wherein the method is for drying an object using a drying fluid, and wherein the directing step includes directing a drying fluid through the coanda slot.

19. The method of claim 18 wherein the drying fluid is a gas.

20. The method of claim 19 wherein the gas is nitrogen.

21. The method of claim 17 wherein the atmosphere comprises ambient air.

22. The method of claim 16 wherein the coanda passage further includes at least one fluid aperture positioned within the coanda passage, and wherein the method further includes directing a second fluid through the aperture onto the object.

23. The method of claim 22 wherein the second fluid is a cleaning fluid.

24. The method of claim 23 wherein the cleaning fluid comprises water.

25. The method of claim 22 wherein the step of directing a second fluid onto the object is performed prior to the step of directing a coanda jet, comprised of a first fluid, onto the coanda profile to induce coanda flow.

26. The method of claim 25 wherein the second fluid is a cleaning fluid and the first fluid is a drying fluid.

27. The method of claim 26 wherein the cleaning fluid comprises water.

28. The method of claim 26 wherein the drying fluid comprises a gas.

29. The method of claim 28 wherein the gas comprises nitrogen.

30. The method of claim 16 wherein the coanda flow forming passage includes a reduced diameter section and wherein the method further includes the step of accelerating the first fluid and entrained atmosphere through the flow passage by causing the first fluid and entrained atmosphere to flow through the reduced diameter section.

* * * * *